US008393282B2

(12) United States Patent
Fujita et al.

(10) Patent No.: US 8,393,282 B2
(45) Date of Patent: Mar. 12, 2013

(54) SEWN PRODUCT AND CLOTHES

(75) Inventors: Kazuya Fujita, Otsu (JP); Kenji Akizuki, Osaka (JP); Takashi Daikyoji, Osaka (JP)

(73) Assignee: Toray Industries, Inc., Tokyo (JP)

( * ) Notice: Subject to any disclaimer, the term of this patent is extended or adjusted under 35 U.S.C. 154(b) by 383 days.

(21) Appl. No.: 12/812,307

(22) PCT Filed: Dec. 25, 2008

(86) PCT No.: PCT/JP2008/073599

§ 371 (c)(1),
(2), (4) Date: Jul. 9, 2010

(87) PCT Pub. No.: WO2009/087914

PCT Pub. Date: Jul. 16, 2009

(65) Prior Publication Data

US 2010/0287679 A1 Nov. 18, 2010

(30) Foreign Application Priority Data

Jan. 11, 2008 (JP) ..... 2008-004053

(51) Int. Cl.
*D05B 93/00* (2006.01)
*H02H 1/04* (2006.01)

(52) U.S. Cl. ..... 112/415; 2/902; 361/212

(58) Field of Classification Search ..... 112/415, 112/417, 418, 429, 432; 428/36.1; 442/197, 442/205, 229, 301; 2/901, 902; 361/220, 361/212, 223; 324/452, 457
See application file for complete search history.

(56) References Cited

U.S. PATENT DOCUMENTS

| | | | | |
|---|---|---|---|---|
| 4,546,497 | A | 10/1985 | Ono et al. | |
| 4,776,160 | A * | 10/1988 | Rees | 57/210 |
| 5,105,056 | A * | 4/1992 | Hoge et al. | 174/356 |
| 6,432,850 | B1 | 8/2002 | Takagi et al. | |
| 6,710,303 | B1 * | 3/2004 | Lorenzen | 219/217 |

(Continued)

FOREIGN PATENT DOCUMENTS

| | | |
|---|---|---|
| JP | 55-135014 | 9/1980 |
| JP | 58-160209 | 10/1983 |
| JP | 63-249705 | 10/1988 |
| JP | 9250007 A | 9/1997 |

(Continued)

OTHER PUBLICATIONS

International Search Report dated Apr. 7, 2009, application No. PCT/JP2008/073599.

*Primary Examiner* — Ismael Izaguirre
(74) *Attorney, Agent, or Firm* — RatnerPrestia

(57) ABSTRACT

A sewn product comprises fabrics having conductive yarns inserted each in a warp direction and a weft direction and disposed in a lattice at intervals, wherein at least two stitches in at least one place of seam are provided with a stitch interval of not more than 5 mm, and a surface resistance (R) between two points separated by 30 cm across at least one seam is according to the formula: $R \leqq 1.0 \times 10^{12} \Omega$. A sewn product comprises fabrics having conductive yarns inserted each in a warp direction and a weft direction and disposed in a lattice at intervals, wherein in at least one place of seam a number of piles of clothing fabrics of seam allowance is 5 or more, and a surface resistance (R) between two points separated by 30 cm across at least one seam is $R \leqq 1.0 \times 10^{12} \Omega$.

9 Claims, 5 Drawing Sheets

U.S. PATENT DOCUMENTS

| | | | | |
|---|---|---|---|---|
| 6,767,603 | B1 * | 7/2004 | Hurst et al. | 428/36.1 |
| 2008/0118187 | A1 * | 5/2008 | Jordan et al. | 383/16 |
| 2008/0125687 | A1 * | 5/2008 | Flick et al. | 602/48 |
| 2008/0230530 | A1 * | 9/2008 | Augustine et al. | 219/212 |

FOREIGN PATENT DOCUMENTS

| | | | |
|---|---|---|---|
| JP | 11-350296 | A | 12/1999 |
| JP | 2001-073207 | A | 3/2001 |

* cited by examiner (a)

(b)

SEWN PRODUCT AND CLOTHES

CROSS REFERENCE TO RELATED APPLICATIONS

This application is a U.S. National Phase Application of PCT International Application No. PCT/JP2008/073599, filed Dec. 25, 2008, which claims priority to Japanese Patent Application No. 2008-004053, filed Jan. 11, 2008, the contents of these applications being incorporated by reference herein in their entirety.

TECHNICAL FIELD OF THE INVENTION

The present invention relates to sewn products and clothes excellent in washing durability on surface electroconductive and antistatic properties. Specifically, it relates to sewn products and clothes capable of continually exhibiting excellent surface electroconductive and antistatic properties in the whole region of clothes without damaging surface electroconductive and antistatic properties largely by repeated washing.

BACKGROUND OF THE INVENTION

Conductive clothes have been conventionally used for preventing electrostatic attraction of dust in a workshop or clean room handling parts and chemicals to which static electricity is an obstacle. In the conductive clothes, conductive yarns are woven into the clothes for taking measures against static electricity. For example, electrostatic attraction of dust is prevented by weaving conductive yarns are woven at a certain interval in a stripe or lattice and neutralizing and diffusing static electricity by corona discharge.

In recent years, as demand characteristics of electrostatic control according to IEC (International Electrotechnical Commission) 61340-5-1, 5-2, surface resistance of conductive clothes has been regulated, and surface electroconductive over the overall clothes may be required. In order to enhance the electroconductive property in the whole region of clothes, the electroconductive property across seam is advantageous, such as in the oblique direction of fabric. In this case, it becomes necessary to weave conductive yarns in a lattice to make contacts in the different directions, and to bring conductive yarns into contact with each other in the sewn part of clothing fabric. However, in the conventional art, there has been a problem that contact of conductive yarns between clothing fabrics deteriorates by washing repeated and the electroconductive property of overall clothes becomes bad or damaged, even though there is no problem for the electroconductive property of overall clothes before washing treatment.

As a method for avoiding this problem, Japanese Unexamined Utility Model Application Publication No. S 58-160209 (1983) provides a method whereby a conductive material is inserted into seam allowance. However, in this method, there remains a problem of not only durability of the conductive material but also high cost. Japanese Unexamined Utility Model Application Publication No. S 55-135014 (1980) discloses a method that conductive yarn is partially used in sewing thread. However, in this method, there also remains a problem that the electroconductive property across seam is not satisfied, and further, the electroconductive property is extremely lowered when puckering occurs by washing.

SUMMARY OF THE INVENTION

The present invention provides sewn products and clothes excellent in washing durability of surface electroconductive and antistatic properties. More specifically, the present invention provides sewn products and clothes capable of continually exhibiting excellent surface electroconductivety and antistatic properties in the whole region of clothes without being damaged surface electroconductivety and antistatic properties of fabric largely by repeated washing, by means of strengthening the contact of conductive yarns between fabrics in seam through devising the stitching method.

The present invention provides a sewn product comprising fabrics having conductive yarns inserted each in a warp direction and a weft direction and disposed in a lattice at intervals, wherein at least two stitches in at least one place of seam are provided with a stitch interval of not more than 5 mm, and a surface resistance (R) between two points separated by 30 cm across at least one seam is according to the formula:

$$R \leqq 1.0 \times 10^{12} \Omega,$$

when measured by a measuring method based on IEC (International Electrotechnical Commission) 61340-5-1, 5-2 regulation (under the temperature and humidity environment of 23° C. and 25% RH) after carrying out washing treatment in JIS L0217 (1995) 103 method.

In another embodiment of the present invention, the sewn product has at least three stitches provided in the at least one place of seam, and the stitch interval is 3 mm or less.

In yet another embodiment of the present invention, the conductive yarns are inserted each in a warp direction and a weft direction and disposed in a lattice at intervals, wherein in at least one place of seam a number of piles of clothing fabrics of seam allowance is 5 or more, and a surface resistance (R) between two points separated by 30 cm across at least one seam is according to the formula:

$$R \leqq 1.0 \times 10^{12} \Omega,$$

when measured by a measuring method based on IEC (International Electrotechnical Commission) 61340-5-1, 5-2 regulation (under the temperature and humidity environment of 23° C. and 25% RH) after carrying out washing treatment in JIS L0217 (1995) 103 method.

In a further embodiment of the present invention, the conductive yarns disposed at intervals in a lattice have a pitch in a range of 1 to 20 mm both in the warp direction and the weft direction. In another embodiment of the present invention, the sewn product further comprises a crimped yarn used as a sewing thread. The present invention also provides clothes comprised of the sewn product described above.

Regarding the sewn product and clothes according to aspects of the present invention, since adhesion pressure of clothing fabric in the sewn part is increased, surface electroconductive property as the whole sewn product is not lowered largely, and it is possible to prevent the electroconductive property in seam from being damaged largely in repeated washing.

Figure 1:
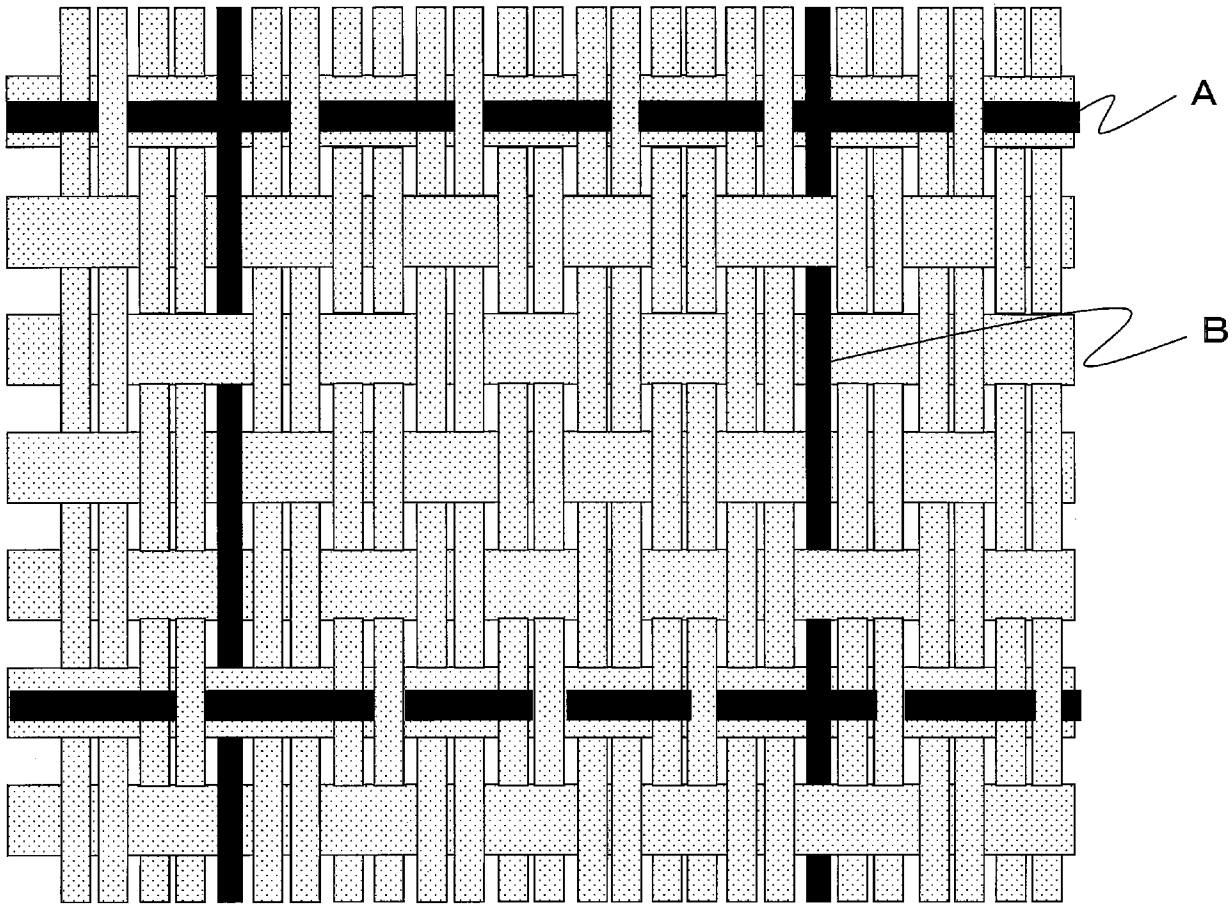
FIG. 1 is a diagram showing weave of fabric in Examples and Comparable Examples (however, the number of base yarns between conductive yarns does not correspond for convenience).

| DESCRIPTION OF NUMBER AND SYMBOL | |
|---|---|
| A. | Conductive yarn incorporated in double weave |
| B. | Conductive yarn inserted by dobby |
| C. | Base polymer part of nonconductive component |
| D. | Polymer part that matrix including carbon is exposed at part of surface |
| E. | Seam (Stitch) by lock stitch sewing machine |
| F. | Overlapped part of fabric |
| G. | Measuring probe (linear distance between probes: 30 cm) |
| H. | Flat felled seam |
| I. | Surface resistance detector |
| N. | Needle interval |
| O. | Direction of sewing needle |
| P. | Seam (Stitch) of sewing machine |

DETAILED DESCRIPTION OF THE INVENTION

The sewn product and clothes of the present invention comprise conductive fabric. The fabric may include only conductive yarn just for exhibiting electrical conductivity. However, in order to exhibit electrical conductivity inexpensively, it preferably includes nonconductive yarn and conductive yarn.

As the nonconductive yarn, there are preferably used, for example, a synthetic yarn and natural yarn, namely, a filament yarn of polyester, nylon etc., spun yarn, a blended yarn of staple of polyester, nylon etc. with rayon staple, cotton yarn etc., further, an antistatic polyester filament yarn or antistatic nylon yarn that a hydrophilic polymer is blended or an hydrophilic group is introduced, and the like.

The conductive yarn may be a yarn containing a conductive component. For example, it is a metal-covered yarn; a yarn composed of conductive yarn that a nonconductive base polymer of polyester or polyamide to be yarn base, and a conductive fine particle of carbon or metal and metal compound etc., or a white-color conductive ceramic fine particle etc., are contained by composite spinning; or a yarn containing these conductive yarns. In an embodiment of the present invention, a conductive yarn with carbon as a conductive component is preferable from the points of durability under acid or alkali environment and washing durability.

As a method for compounding a conductive component, there are methods for yarn making, such as core-in-sheath, covering and partially surface exposing types. In the case of being used as dust-proof clothes for clean rooms of high cleanness, a covering type conductive yarn that core yarn was covered by a conductive component, and a partially surface exposing type yarn that a conductive component was exposed partially at the surface may lead to dust generation from the conductive component and contamination of workshop. Thus, core-in-sheath type yarn that a conductive component was included inside is preferably used. On the other hand, in a workshop where that high cleanness is not required, by using the above-described partially surface exposing type yarn, it is possible to obtain cloth of lower surface electric resistance.

The partially surface exposing type yarn means a yarn where a conductive component is exposed partially in the circumferential direction in the cross section of single fiber composing a yarn, and the conductive component exposed is exposed continuously in the longitudinal direction of single fiber. The cross-sectional shape or the like is not limited, but it is preferable that a conductive component is exposed at the convex part of cross section of single fiber. In this state, probability that the conductive component makes contact between conductive yarns becomes high, and the delivery and receipt of electric charges becomes smooth. Additionally, a convex part of cross section is not flat but a curved line or horn in the peripheral direction of cross section, including circumference of circular cross section. As a more specific example of such yarn, it is a conductive yarn composed of fibers with a circular cross section shown in FIG. 2 (*a*) or with an irregular cross section having a convex part shown in FIG. 2 (*b*). The place where the conductive component is exposed is not restricted; from the viewpoint of the conductive component exposing ratio in the fabric surface and the delivery and receipt of electric charges between single fibers of conductive yarn, it is preferable that at the outer circumferential surface of the single fiber, a conductive component is exposed in at least 3 places in the circumferential direction and continuously in the longitudinal direction.

The conductive component may be exposed at the whole outer circumferential surface of single fiber. In this case, although there remains a problem of yarn strength and peeling due to abrasion, the delivery and receipt of electric charges between conductive yarns is done without disturbance.

Further, a conductive yarn in another embodiment of the present invention can be formed by doubling, twisting or comingling a yarn containing these conductive components with a synthetic yarn or natural yarn.

As the conductive yarn, for example, one with a single fiber fineness of 1 to 10 dtex and the total yarn fineness of 10 to 150 dtex is used. The electric resistance of conductive yarn is preferably $10^9$ Ω/cm or less, in particular, $10^8$ Ω/cm or less. Additionally, electric resistance of conductive yarn means specific resistance that under the environment of 20° C. and 30% RH, electric voltage is loaded on both ends filament-cut to 10 cm (500 V set in this case).

In at least one embodiment of the present invention, the fabric is a fabric that conductive yarns are inserted in the warp direction and the weft direction and disposed in a lattice at intervals. In this time, it is suitable to use a textured yarn such covering yarn or textured yarn called TASURAN, exposing a conductive yarn by having a difference in yarn length around a nonconductive yarn so that the conductive yarns between clothing fabrics contact easily when sewn for the conductive yarns to be exposed at the fabric surface relative to base weave composing a fabric. Further, suitable is a method that conductive yarns are inserted as double weave to be a float yarn on the fabric surface, namely, they are exposed in a shape protruded from the base weave.

Here, the case that conductive yarns are inserted as double weave to be a float yarn on the fabric surface is explained. The conductive yarns are incorporated in one of the warp direction and the weft direction, or in both as double weave to be disposed on (or beneath in the reverse side of) base yarn (ordinarily nonconductive yarn) composing the base weave of the same direction. Namely, in the double weave, the conductive yarn is exposed on the fabric as a float yarn to be a protruded shape from the base weave. In this way, the area exposed at the fabric surface is increased, and contact with conductive yarn in other direction is improved, so that the neutralization and diffusion of static electricity becomes easy.

When the total yarn fineness D1 of conductive yarn to be inserted in double weave is set to be smaller than that of nonconductive yarn being base yarn D2, the conductive yarn is easy to take a position being disposed on the base yarn (nonconductive yarn), and the delivery and receipt of electric charges is efficiently done at the intersection of the conductive yarns to be able to improve electroconductive property. In particular, a force pushing down by the orthogonal other yarns is operated on the conductive yarn in fabric, and by satisfying D1<D2, the conductive yarn inserted in double weave is easily disposed on the base yarn. Hence, even when the fineness of conductive yarn or the number of filaments is reduced, the surface resistance does not deteriorate extremely, and it becomes possible to reduce weaving costs by adopting the finer conductive yarn.

Even when D1≧D2, it does not bother for performance of conductive fabric, but the cost of conductive yarn becomes more, which will not be a preferable mode because conductive performance of fabric becomes saturated. In the case that the fineness of conductive yarn is large, when it is inserted in double weave, disposing it on base yarn becomes difficult; for example, there arise problems that the conductive yarn is disposed partially rolling down from above the base yarn, or friction at the conductive yarn inserting part in fabric becomes strong.

Additionally, when the conductive yarn is not disposed on (or beneath) the nonconductive yarn (base yarn) of the same direction but disposed between nonconductive yarns of the same direction, the conductive yarn is buried easily in the base yarn (nonconductive yarn) and the contact with orthogonal conductive yarn lowers; thus, the neutralization and diffusion of static electricity tends to become insufficient. Hence, in the case that conductive yarn is not to be a float yarn but disposed between nonconductive yarns of the same direction, the fineness of conductive yarn is preferably equal to or more than the fineness of base yarn of the same direction. By adjusting the fineness ratio in this way, the conductive yarn is easily protruded on fabric surface relative to nonconductive yarn, and conductive yarns between clothing fabrics are easily contacted in sewing.

In a fabric according to embodiments of the present invention, conductive yarns are inserted and disposed at least in each the warp direction and the weft direction into a stripe at a certain interval. As the interval that the conductive yarns are inserted and disposed, the narrower it is, the better the conductive characteristic becomes. From the balance among conductive characteristic, drape, aesthetic property, appearance quality, cost and the like, it is preferably set for the pitch to be about 1 to 20 mm. When the pitch is less than 1 mm, the number of conductive yarns disposed becomes too large, which is not preferable from the points of drape, appearance and quality, and production cost of conductive yarn. When the pitch is more than 20 mm, it is necessary to have more seam allowance width not so as to increase surface resistance across seam, which is not preferable from the production cost of fabric. The pitch is more preferably about 1 to 10 mm.

The sewn product according to embodiments of the present invention is one that the fabrics described above are sewn. The first mode of the sewn product in an embodiment of the present invention is a sewn product where at least two stitches in at least one place of seam are provided, and the interval of the stitches (needle interval) is not more than 5 mm. By this way, it becomes possible to increase the chance of contact of conductive yarns between different fabrics in seam, and to lower the surface resistance between two points across seam. Additionally, it is possible to increase adhesion pressure among fabrics in the sewn part and to prevent the electroconductive property in seam from being damaged largely in repeated washing.

When the needle interval exceeds 5 mm, from a kneading effect and shrinkage of fabric by repeated washing, there arise a tendency to take an undulated shape in seam allowance. In such embodiment, the conductive yarn contacted among fabrics in seam is peeled off, and the electroconductive property across seam deteriorates. Therefore, by shortening the needle interval, it is possible to prevent the conductive yarn from peeling off due to a kneading effect and shrinkage of fabric by repeated washing.

On the other hand, when as many stitches as possible are provided in seam allowance of a certain width, peeling off by repeated washing hardly occurs. However, taking the workload of sewing into consideration, the needle interval is preferably set to 2 mm or more. Further, in order to achieve a good balance between sewing workability and washing durability of surface resistance, the needle interval is preferably set to be not less than 2 mm and not more than 3 mm. Additionally, the number of stitches is determined by seam allowance width and needle interval.

Needle interval herein is a distance in the perpendicular direction to the two parallel lines of seams in seam allowance; the intervals at 5 places randomly chosen in the seam direction are measured using a scale measurable in an accuracy of 0.5 mm, and a value as the needle interval is calculated from the measured values that tenth place is rounded off in arithmetic average. Arithmetic average is a value that all values measured are summed, which is divided by the number of data (n number). Additionally, in the case that seam is not a straight line, a central axis line showing the sewing direction of seam is assumed, and a distance till a perpendicular line drawn from the central axis line intersects the other central axis line is the needle interval. For example, in the case that a zigzag pattern is formed, a line passing through the center of the width is a central axis line.

A second mode of the sewn product of the present invention is that in sewing the above-described fabrics, the number of piles of clothing fabrics in seam allowance is 5 or more. The number of piles is the number of clothing fabrics through which a needle is penetrated in seam. For example, in the case of using a piping tape in seam, the number of the tapes is to be counted.

By setting the number of piles of clothing fabrics in seam allowance to be 5 or more, it is possible to increase adhesion pressure among fabrics in the sewn part and to prevent the electroconductive property in seam from being damaged largely by repeated washing. Namely, an increase in surface resistance is suppressed even when it is measured across seam after washing. In stitching when the number of piles of seam allowance is less than 5, fastening seam becomes insufficient due to a kneading effect by washing, or a possibility that puckering occurs due to shrinkage of fabric becomes high. Hence, peeling of the contact of conductive yarn occurs, thereby increasing the surface resistance across seam extremely. Additionally, when the number of piles of seam allowance becomes more than 7, contact pressure between conductive yarns becomes strong, and the surface resistance across seam lowers; although that is a preferable, since thickness and rigidity of the sewn part become large, uncomfortable feeling in wearing tends to increase. Therefore, the number of piles is preferably 7 or less.

Figure 5:
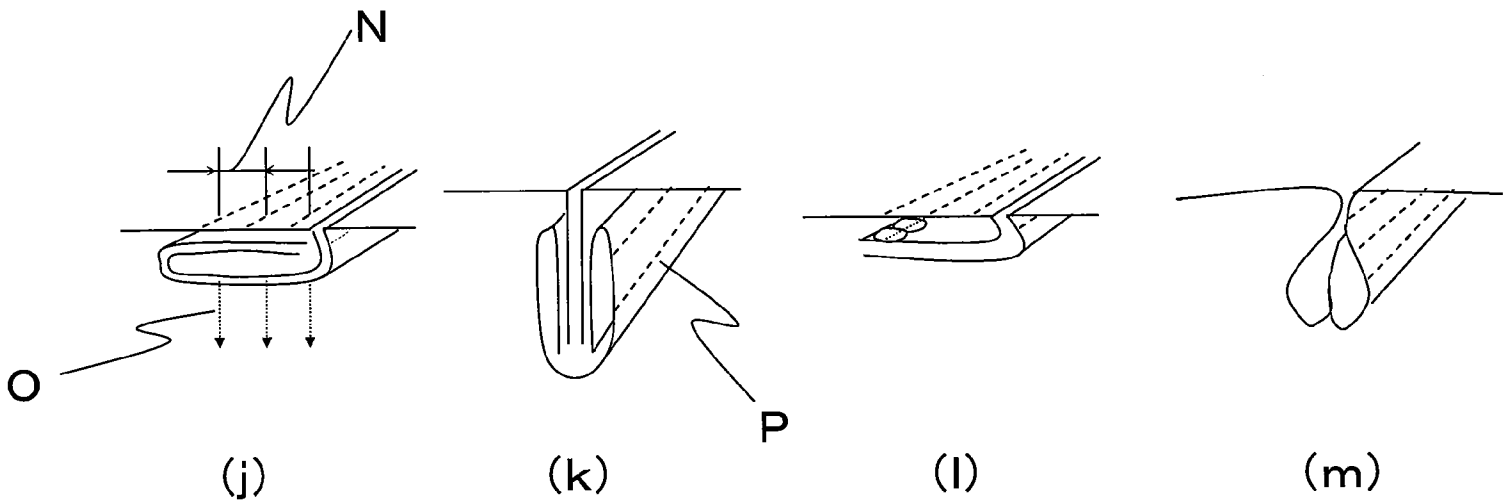
FIG. 5 is a schematic diagram of a typical stitching method.

The piling method of clothing fabrics in seam is not particularly limited. For example, as shown in FIG. 5, stitching methods such as three-rolled seam (j), piping (k), safety stitch (l) and bag seam (m) are listed. For other rolled seam and piping, or change stitching methods based on flat felled seam and bag seam, there is no problem when the number of piles is 5 or more. However, from the viewpoints of strength and stitching load, three rolled seam is preferable.

Here, by using the first mode of stitching method, target surface resistance $R \leqq 1.0 \times 10^{12} \Omega$ can be achieved even if the number of piles of seam allowance is less than 5. However, even in the first mode, it is possible to enhance the electroconductive property in repeated washing by increasing the number of piles. Namely, in embodiments of the present invention, using the first mode and the second mode in combination exhibits a larger effect. Specifically, when fabrics that conductive yarns are inserted each in the warp direction and the weft direction and disposed in a lattice at intervals are sewn, two or more stitches are provided in seam by a needle interval of 5 mm or less, and the number of piles of clothing fabrics in seam allowance is set to 5 or more, it is possible to obtain sewn products or clothes where surface resistance across seam hardly increases (deteriorates) even being washed repeatedly.

By fastening a yarn according to its yarn tension of a sewing machine, adhesion strength of fabrics can be increased, and surface resistance between two points across seam can be reduced. However, it may easily cause generation of sewing shrinkage and puckering. According to the first mode and the second mode of the present invention, generation of such sewing shrinkage and puckering can be prevented.

In the first mode and the second mode described above, seam allowance width may be determined by the pitch of conductive yarns in a conductive fabric. Preferably, two or more conductive yarns running in parallel with the seam direction are inserted each in seam allowances of both fabrics, and the seam allowance width is set to 5 mm or more. The longer the seam allowance width is, the more the deterioration of surface resistance can be prevented, but production cost of fabric increases that much. On the other hand, when seam allowance width is less than 5 mm, it is not preferable from the viewpoints of workload of sewing product and strength of seam. The number of conductive yarns in seam allowance is each preferably 2 to 5.

Stitching of seam allowance is carried out by a stitching method selected from the group consisting of lock stitch, single chain stitch, double chain stitch, overedge chain stitch and covering chain stitch. "Lock stitch" is a seam produced generally by using a sewing machine, the constitution of seam is independent in every stitch, front-back seams are the same, and it is a characteristic sewing method that hardly unravels. "Single chain stitch" is a sewing method that seam is produced by only one needle yarn; in the reverse side, loops of needle yarn continue in forming a chain shape each other continuously. "Double chain stitch" is sewing method that there are top threads above and looper threads below, and the looper thread and top thread are tangled each other. This stitching method has a characteristic that even when thread is broken, it hardly unravels unless being raveled from the sewing end to the reverse direction, having a high strength in seam and a sufficient stretch. "Overedge chain stitch" is a sewing method that end of cloth is sewn like wrapping, and it is a characteristic sewing method giving a sufficient stretch. "Covering chain stitch" is ordinarily called flat seam stitch, seam is composed of three kinds of threads, that is, needle thread above, looper thread below and covering thread, it is sewing method capable of producing a stable seam with sufficient stretch and excellent strength. These stitching methods are a well-known typical sewing method, and the stitching is not limited to these, and the effect does not vary for change stitch such as zigzag chain stitch.

In each stitch, needle swing width is preferably 5 mm or less (6 needles/3 cm or more). When more than 5 mm, it becomes a cause for generating undulation of clothing fabric after washing, and leads to deterioration of electroconductive property between fabrics. It is more preferably 3 mm or less (10 needles/3 cm or more). When less than 1 mm (30 needles/3 cm or more), deterioration of electroconductive property is prevented, but load in work becomes large.

In some embodiments of the present invention, for stitching of fabric, using a crimped yarn is preferable. In the seam formed by using a crimped yarn, contact pressure between clothing fabrics is enhanced by a strong shrinkage recovery of crimped yarn, and electroconductive property between clothing fabrics is enhanced as well.

As the crimped yarn, a false twist yarn or a potentially crimped yarn conjugated is suitably used. As the kind of crimped yarn, there is listed a multifilament yarn made of one kind or various kinds of thermoplastic polymers, in addition to nylon or polyester. In the case that a seam composed of upper yarn and lower yarn is formed by using a sewing machine, a crimped yarn can be used for one of upper yarn and lower yarn, or for both. However, in the case that forming a seam is difficult when a crimped yarn is used as upper yarn because of structural problem of a sewing machine, a crimped yarn is used only for lower yarn; and for upper yarn, a common filament or spun sewing yarn can be used without problem.

The total yarn fineness of crimped yarn is not particularly limited. When a crimped sewing yarn of 100 to 300 decitex is used, a sufficient shrinkage recovery is obtained, and washing durability of surface resistance between two points across seam is easily achieved. Namely, when the total yarn fineness of crimped yarn is less than 100 decitex, contact pressure of seam after washing becomes small since the intrinsic shrinkage recovery is not sufficiently exhibited, and surface resistance tends to become bad. Reversely, when more than 300 decitex, because of large fineness of sewing thread, strain of sewing is generated in the part of seam by washing and appearance sometimes becomes bad although shrinkage recovery is sufficiently exhibited.

As a method for further preventing the deterioration of surface resistance (electroconductive property) across seam by repeated washing, there are listed a method that seam allowance is entirely or partially melt-bonded, or reinforced with a seam tape, and the like. By melt-bonding seam allowance entirely or partially, conductive yarns included in seam allowance of clothing fabric sewn are pressure bonded or melt-bonded each other to strengthen the contact; thus, it becomes possible to greatly reduce surface resistance across the seam of clothes. Further, since there are no occurrence of contact failure of conductive yarns due to shrinkage of clothing fabric and puckering by washing, durability becomes very good. Also by seam tape, contact between fabrics becomes strong, and the same effect is obtained.

The melt-bonding method of seam allowance is by no means limited; there are listed a method that melt-bonding is carried out by bringing the clothing fabric piled into contact with or approach to a heating element (hot plate etc.), or by blowing hot air thereto. However, the surface of clothing fabric contacted with a hot plate or blown with hot air is sometimes damaged terribly, also melt-bonding takes time, and there is a case that the melt-bonded part is inferior in aesthetic property. Therefore, more preferably, a method of hot melt bonding by giving an ultrasonic vibration via horn is listed. By using this method, melt-bonding of clothing fabrics is carried out uniformly; thus, stitching by melt-bonding can be efficiently done to solve the problem of aesthetic property.

In melt-bonding, it is preferable that intersection of conductive yarns of clothing fabrics piled in two pieces to be stitched exists in the melt-bonding part. By melt-bonding the part including the intersection of conductive yarns, it is possible to pressure bond the conductive yarns each other more strongly, and further to melt-bond the conductive yarns each other. Even if the part including intersection of conductive yarns is not melt-bonded, pressure bonding of conductive yarns can be done by melt-bonding the periphery. However, from consideration of strength of seam, it is preferable that seam allowance is melt-bonded in whole. In the case that the part including the intersection of conductive yarns is melt-bonded, when interval of conductive yarns in fabric is wide, melt-bonding width needs to be widen; however, when melt-bonding is carried out in the width at least equal to the interval of conductive yarns, the intersection of conductive yarns is melt-bonded, and the surface resistance across seam can be reduced greatly. Additionally, in the case that clothing fabric is sewn obliquely (oblique to warp and weft of fabric), points that conductive yarns intersect with each other between fabrics in seam allowance increase; thus, it becomes possible to shorten the melt-bonding width.

In the case of carrying out melt-bonding treatment in addition to stitching by sewing thread, the order is basically not restricted. However, when a sewing thread contains a thermoplastic component, there is a case that the sewing thread melts in melt-bonding treatment to cause the lowering of strength. Therefore, from the viewpoint of strength of seam, it is preferable to carry out stitching treatment by sewing thread after melt-bonding treatment. The stitching by sewing thread is preferably carried out in conjunction with top-stitched plain seam or rolled seam. Even in flat felled seam and piping, or change stitching methods based on bag seam, unless contact of conductive yarns by melt-bonding is done, it is good because washing durability of surface resistance is achieved. In the case of concomitant use of a seam tape, the order is not restricted; however, carrying out melt-bonding treatment before attaching a seam tape is preferable because melt-bonding treatment can be uniformly done since thickness of clothing fabric is thin.

As the seam tape, for example, there can be used a well-known hot-melt type seam tape where resins such as high melting point polyamide, polyolefin, polyester and polyurethane are used as a base cloth layer, and hot melt adhesive resins such as low melting point polyamide, polyolefin, polyester and polyurethane are used as a adhesive layer. There can be used a method that such seam tape is contacted with a seam part, and the thermal adhesive resin is melt-bonded thereto by high frequency wave, ultrasonic wave, hot press or the like, or a method of sealing by bonding after thermal adhesive resin is melted by hot air or the like, or a method of bonding a base cloth to be sealed by coating a sticking-type adhesive typified by rubber system onto a seam part, or the like.

According to the at least one embodiment of the present invention as described above, a sewn product becomes one satisfying a demand characteristic specified by IEC (International Electrotechnical Commission) 61340-5-1, 5-2 being electrostatic control regulation. The demand characteristic specified by IEC (International Electrotechnical Commission) 61340-5-1, 5-2 being electrostatic control regulation is that "under the temperature and humidity environment of 23° C. and 25% RH, when surface resistance is measured at an applied voltage of 10 V or 100 V between two points separated by 30 cm in the oblique direction across at least one seam, the surface resistance R is not more than $1.0\times10^{12}\Omega$". Here, the applied voltage is chosen according to the surface resistance of test piece, 10 V in the region of not more than $10^5\Omega$, and 100 V in the region of not less than $10^6\Omega$ are chosen.

In order to achieve this demand characteristic more surely, it is preferable that the surface resistance R of the fabric to be sewn satisfies $R\leqq1.0\times10^{12}\Omega$ when the fabric is measured in the same way as IEC (International Electrotechnical Commission) 61340-5-1, 5-2 except for the change being not across seam. From the consideration of electrostatic diffusiveness, R in such measurement is further preferably not more than $1.0\times10^{10}\Omega$, and $1.0\times10^6\Omega$ to $1.0\times10^9\Omega$ is most preferable. In such range, static electricity is diffused efficiently and quickly, spark electric shock from a charged body can be prevented, and it becomes possible to be used suitably as antistatic working clothes and dust-proof clothing applications.

The sewn product according to aspects of the present invention as described above is excellent in washing durability, thus it can be suitably used as clothes and the like. Namely, even if static electricity is generated in any part after repeated washing, corona discharge from conductive yarns occurs or earthing is positively done since fabric and clothes overall are stably electroconductive.

EXAMPLES

Next, the present invention is explained specifically by using Examples, but the present invention is by no means limited to these Examples. Additionally, various measuring methods in the present invention are as follows.

Needle Interval of Seam:

In regard to the distance in the perpendicular direction to two lines of stitches running parallel in seam of clothes, intervals at 5 places (n=5) randomly chosen in the seam direction are measured using a scale measurable in an accuracy of 0.5 mm, and tenth place of the value calculated in arithmetic average is rounded off into a whole number. Arithmetic average is a value calculated from summing up all the values measured and dividing by the number of data (n number).

Surface Resistance:

It was measured as bellow based on IEC (International Electrotechnical Commission) 61340-5-1, 5-2 regulation.

Figure 3:
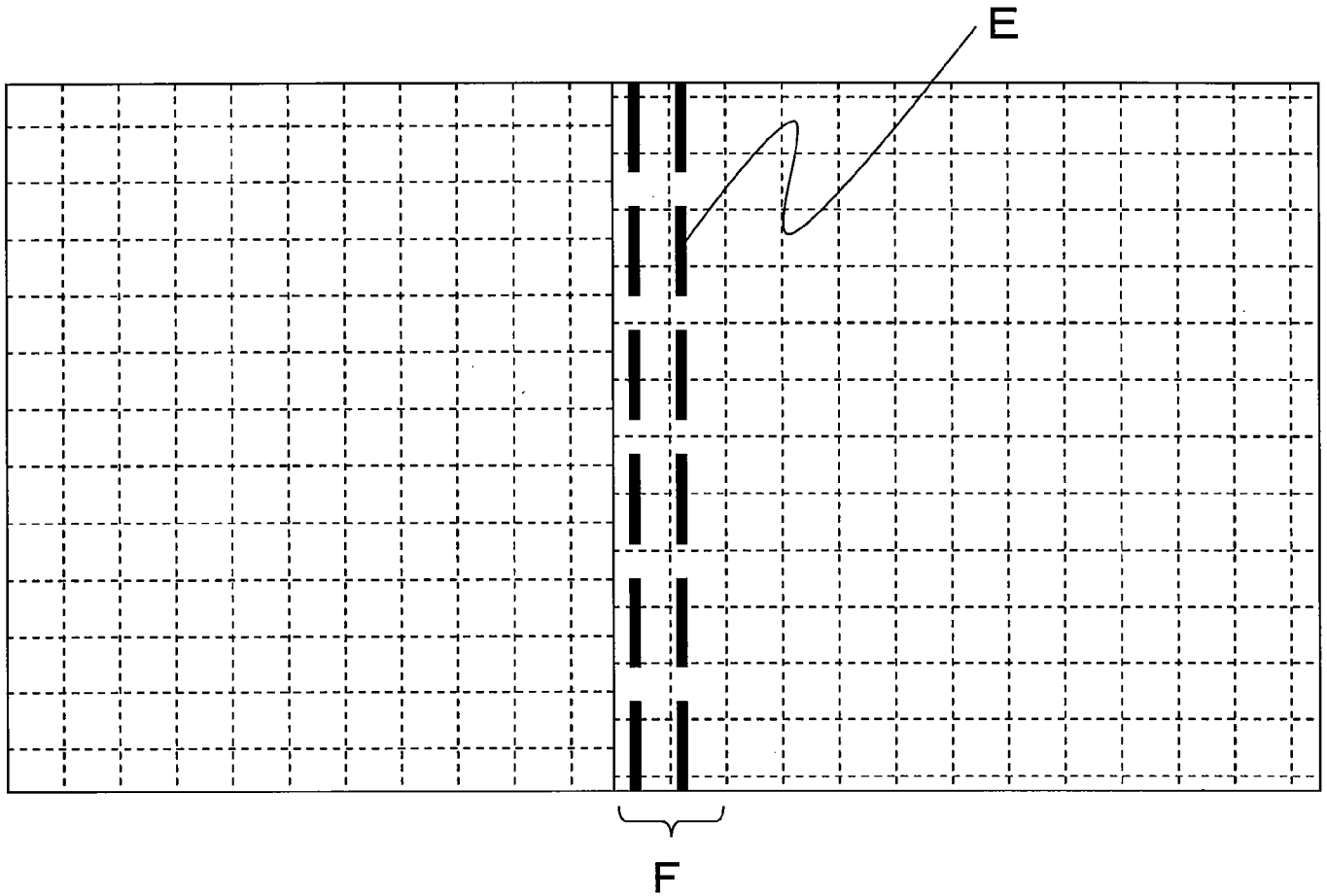
FIG. 3 is one example of piling methods of fabrics in stitching two pieces of fabrics to measure surface resistance.
Figure 4:
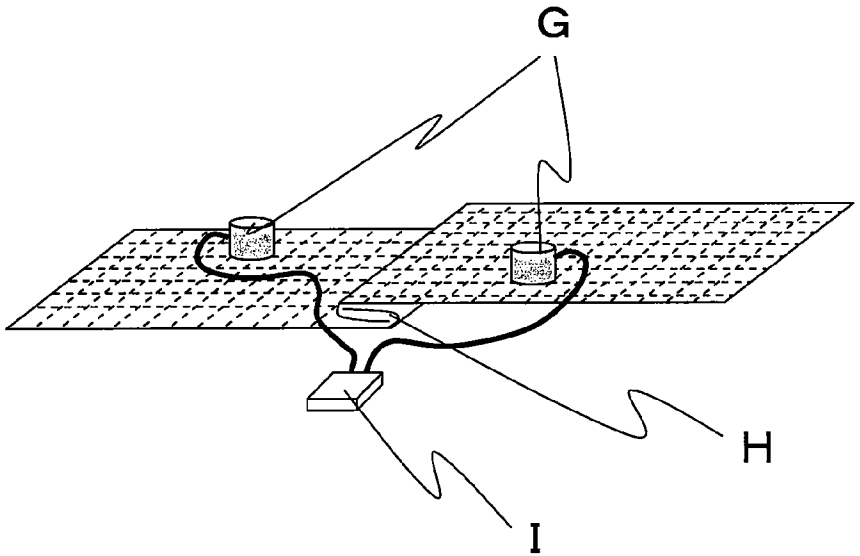
FIG. 4 is a schematic diagram of measuring method of surface resistance across seam.

Clothes (blouson) are produced by carrying out a predetermined stitching by a sewing machine. Thereafter, using a surface resistance tester (Model 152AP-5P manufactured by Trek Japan Co., Ltd.), in a laboratory of the temperature and humidity environment of 23° C. and 25% RH, measuring probes are mounted at an interval of 30 cm across the seam of the sewn product, and surface electric resistance is measured at an applied voltage of 100 V. In this time, the two points are taken so that the coaxial conductive yarns of fabric specimen are not included. This is repeated at arbitrary three places to calculate the arithmetic average. FIG. 3 shows a schematic diagram after sewing, and FIG. 4 shows a schematic diagram for measuring surface electric resistance.

Example 1

Figure 2:
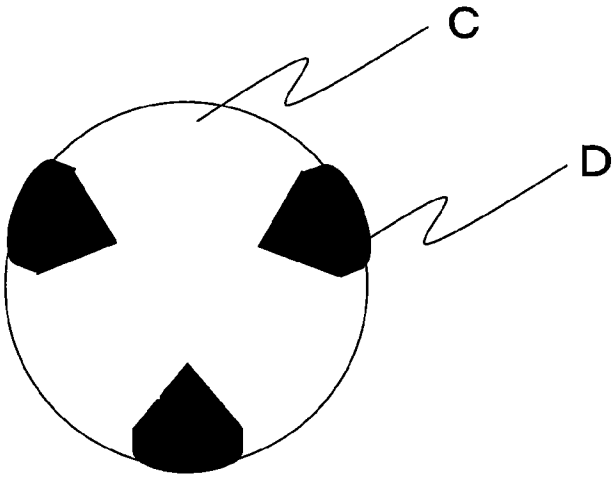
FIG. 2 is a cross sectional view of a partial surface exposing type yarn usable in an embodiment of the present invention.
Figure 2:
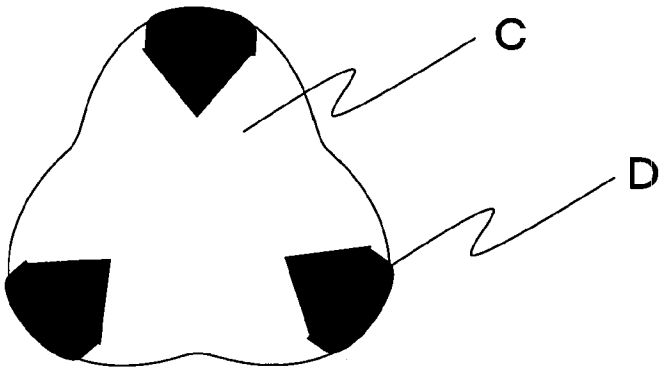

Using two-ply yarn of polyester false twist yarn (84 decitex, 36 filaments) as a warp forming base weave and polyester false twist yarn (334 decitex, 96 filament) as a weft, and as a warp conductive yarn and a weft conductive yarn, a conductive yarn (84 decitex, 9 filaments) composed of surface exposing type yarn shown in FIG. 2 was used. The weave was made as shown in FIG. 1 in such manner that base weave was plain fabric (one-sided mat), and the warp conductive yarns were disposed by dobby weave in a ratio of every 24 yarns of base warps (pitch 5 mm) in skipping over 2 yarns in the obverse side, and one yarn in the reverse side. Additionally, the weave was made as shown in FIG. 1 in such manner that the weft conductive yarns were inserted in a ratio of every 11 yarns of base wefts in weft double weave (pitch 5 mm), and disposed on the base weft (namely being float yarn) in skipping over 3 yarns in the obverse side, and one yarn in the reverse side. In this way, a gray fabric of 141 yarns/2.54 cm in warp density and 57 yarns/2.54 cm in weft density was produced. This gray fabric was refined, dyed and finished according to the common method to obtain a fabric of 153 yarns/2.54 cm in finish warp density and 62 yarns/2.54 cm in weft density.

Using the fabric obtained and setting seam allowance width to 15 mm, stitching was carried out by a lock stitch sewing machine. A twisted yarn of 60 count filament was used as a sewing thread, and stitching was carried out by 2 stitches (seam) in three-rolled seam (see FIG. 5 (*j*)) and needle interval of 3 mm. After carrying out washing treatment in JIS L0217 (1995) 103 method once and 20 times, surface resistances were measured. Various data are shown in Table 1.

Example 2

Using the fabric obtained in Example 1 and setting seam allowance width to 15 mm, stitching was carried out by a double chain stitch sewing machine. A twisted yarn of 60 count filament was used as a sewing thread, and stitching was carried out by 2 stitches (seam) in three-rolled seam (see FIG. 5 (*j*)) and needle interval of 6 mm. After carrying out washing treatment in the same condition as Example 1, surface resistances were measured. Various data are shown in Table 1.

Example 3

Using the same yarns as Example 1, the weave was made as shown in FIG. 1 in such manner that base weave was plain fabric (one-sided mat), and the warp conductive yarns were disposed by dobby weave in a ratio of every 48 yarns of base warps (pitch 10 mm) in skipping over 2 yarns in the obverse side, and one yarn in the reverse side. The weave was made as shown in FIG. 1 in such manner that the weft conductive yarns were inserted in a ratio of every 22 yarns of base wefts in weft double weave (pitch 10 mm), and disposed on the base weft (namely being float yarn) in skipping over 3 yarns in the obverse side, and one yarn in the reverse side. In this way, a gray fabric of 141 yarns/2.54 cm in warp density and 57 yarns/2.54 cm in weft density was produced. This gray fabric was refined, dyed and finished according to the common method to obtain a fabric of 153 yarns/2.54 cm in finish warp density and 62 yarns/2.54 cm in weft density.

Using the fabric obtained and setting seam allowance width to 30 mm, stitching was carried out by a lock stitch sewing machine. A twisted yarn of 60 count filament was used as a sewing thread, and stitching was carried out by 3 stitches (seam) in three-rolled seam (see FIG. 5 (*j*)) and needle interval of 3 mm each. After carrying out washing treatment in JIS L0217 (1995) 103 method once and 20 times, surface resistances were measured. Various data are shown in Table 1.

Example 4

Using the fabric obtained in Example 1 and setting seam allowance width to 15 mm, stitching was carried out by a lock stitch sewing machine. A twisted yarn of 60 count filament (upper yarn) as a sewing thread and a crimped yarn of 220 decitex (lower yarn) were used, and stitching was carried out by 2 stitches (seam) in three-rolled seam (see FIG. 5 (*j*)) and needle interval of 3 mm each. After carrying out washing treatment in JIS L0217 (1995) 103 method once and 20 times, surface resistances were measured. Various data are shown in Table 1.

Example 5

Using the fabric obtained in Example 1 and setting seam allowance width to 15 mm, stitching was carried out by a lock stitch sewing machine. A twisted yarn of 60 count filament was used as a sewing thread, and stitching was carried out by 2 stitches (seam) in piping with bias tape (see FIG. 5 (*k*)) and needle interval of 3 mm. After carrying out washing treatment in JIS L0217 (1995) 103 method once and 20 times, surface resistance were measured. Various data are shown in Table 1.

Example 6

Using the fabric obtained in Example 1 and setting seam allowance width to 15 mm, stitching was carried out by a lock stitch sewing machine. A twisted yarn of 60 count filament was used as a sewing thread, and stitching was carried out by 2 stitches (seam) in flat felled seam (see FIG. 4 (H)) and needle interval of 5 mm. After carrying out washing treatment in JIS L0217 (1995) 103 method once and 20 times, surface resistances were measured. Various data are shown in Table 1.

Example 7

Using the fabric obtained in Example 1 and setting seam allowance width to 15 mm, safety stitching and top-stitching (see FIG. 5 (*l*)) were carried out.
A twisted yarn of 60 count filament was used as the upper yarn of sewing thread, and a crimped yarn of 220 decitex was used as the lower yarn; stitching was carried out by 3 stitches (seam) in needle interval of 5 mm. After carrying out washing treatment in JIS L0217 (1995) 103 method once and 20 times, and after carrying out washing treatment in the same condition as Example 1, surface resistances were measured. Various data are shown in Table 1.

Example 8

Using the fabric obtained in Example 1 and setting seam allowance width to 15 mm, stitching was carried out by using a double chain stitch sewing machine. A twisted yarn of 60 count filament (upper yarn) and a crimped yarn of 220 decitex (lower yarn) were used as a sewing thread, and stitching was carried out by 3 stitches (seam) in flat felled seam (see FIG. 4 (H)) and needle interval of 4 mm. After carrying out washing treatment in JIS L0217 (1995) 103 method once and 20 times, surface resistances were measured. Various data are shown in Table 1.

Example 9

Using the fabric obtained in Example 1, setting seam allowance width to 15 mm, stitching was carried out by using a lock stitch sewing machine. A twisted yarn of 60 count filament (upper yarn) and a crimped yarn of 220 decitex (lower yarn) were used as a sewing thread, and stitching was carried out by 3 stitches (seam) in flat felled seam (see FIG. 4 (H)) and needle interval of 4 mm. After carrying out washing treatment in JISL0217 (1995) 103 method once and 20 times, surface resistances were measured. Various data are shown in Table 1.

Example 10

Using the fabric obtained in Example 1, setting seam allowance width to 15 mm, safety stitching and top-stitching (see FIG. 5 (*l*)) were carried out. A twisted yarn of 60 count filament was used as the upper yarn of sewing thread, and a crimped yarn of 220 decitex was used as the lower yarn; stitching was carried out by 3 stitches (seam) in needle interval of 3 mm. After carrying out washing treatment in JIS L0217 (1995) 103 method once and 20 times, and after carrying out washing treatment in the same condition as Example 1, surface resistances were measured. Various data are shown in Table 1.

Comparative Example 1

Using the fabric obtained in Example 1 and setting seam allowance width to 15 mm, safety stitching and top-stitching (see FIG. 5 (*l*)) were carried out by a lock stitch sewing machine. A twisted yarn of 60 count filament was used as a sewing thread, and stitching was carried out by 2 stitches (seam) in needle interval of 7 mm. After carrying out washing treatment in JIS L0217 (1995) 103 method once and 20 times, surface resistances were measured. Various data are shown in Table 1.

Comparative Example 2

Using the fabric obtained in Example 1 and setting seam allowance width to 15 mm, stitching was carried out by a lock stitch sewing machine. A twisted yarn of 60 count filament was used as a sewing thread, and stitching was carried out by 2 stitches (seam) in flat felled seam (see FIG. 4 (H)) and needle interval of 7 mm. After carrying out washing treatment in JIS L0217 (1995) 103 method once and 20 times, surface resistances were measured. Various data are shown in Table 1.

Comparative Example 3

Using the fabric obtained in Example 1 and setting seam allowance width to 20 mm, stitching was carried out by using a lock stitch sewing machine. A twisted yarn of 60 count filament (upper yarn) and a crimped yarn of 220 decitex (lower yarn) were used as a sewing thread, and stitching was carried out by 2 stitches (seam) in flat felled seam (see FIG. 4 (H)) and needle interval of 8 mm. After carrying out washing treatment by the same condition as Example 1, surface resistances were measured. Various data are shown in Table 1.

The invention claimed is:

1. A sewn product comprising fabrics having conductive yarns inserted each in a warp direction and a weft direction and disposed in a lattice at intervals, wherein at least two stitches in at least one place of seam are provided with a stitch interval of not more than 5 mm, and a surface resistance (R) between two points separated by 30 cm across at least one seam is $R \leqq 1.0 \times 10^{12} \Omega$.

2. The sewn product of claim 1, wherein at least three stitches are provided in the at least one place of seam, and the stitch interval is 3 mm or less.

3. The sewn product of claim 1, wherein the conductive yarns disposed at intervals in a lattice have a pitch in a range of 1 to 20 mm both in the warp direction and the weft direction.

4. The sewn product of claim 1, further comprising a crimped yarn used as a sewing thread.

5. Clothes comprised of the sewn product of claim 1.

6. A sewn product comprising fabrics having conductive yarns inserted each in a warp direction and a weft direction and disposed in a lattice at intervals, wherein in at least one place of seam a number of piles of clothing fabrics of seam allowance is 5 or more, and a surface resistance (R) between two points separated by 30 cm across at least one seam is according to the formula: $R \leqq 1.0 \times 10^{12} \Omega$.

7. The sewn product of claim 6, wherein the conductive yarns disposed at intervals in a lattice have a pitch in a range of 1 to 20 mm both in the warp direction and the weft direction.

TABLE 1

| | | Machine sewing yarn | | | The number | Needle | | Surface resistance (Ω) | | |
|---|---|---|---|---|---|---|---|---|---|---|
| | Stitch | Upper yarn | Lower yarn | Stitching method | of piles (pieces) | interval (mm) | Stitch (llines) | Before washing | After washing once | After washing 20 times |
| Example 1 | Lock stitch | Twisted yarn | | Three-rolled seam | 5 | 3 | 2 | 5.45 × 106 | 1.08 × 107 | 1.72 × 107 |
| Example 2 | Double chain stitch | Twisted yarn | | Three-rolled seam | 5 | 6 | 2 | 5.93 × 106 | 5.44 × 108 | 9.54 × 108 |
| Example 3 | Lock stitch | Twisted yarn | | Three-rolled seam | 5 | 3 | 3 | 3.29 × 106 | 9.73 × 106 | 1.33 × 107 |
| Example 4 | Lock stitch | Twisted yarn | Crimped yarn | Three-rolled seam | 5 | 3 | 2 | 6.15 × 106 | 9.17 × 106 | 1.19 × 107 |
| Example 5 | Lock stitch | Twisted yarn | | Piping | 6 | 3 | 2 | 8.03 × 106 | 3.49 × 109 | 8.25 × 109 |
| Example 6 | Lock stitch | Twisted yarn | | Flat felled stitch | 4 | 5 | 2 | 6.43 × 106 | 4.72 × 1010 | 4.74 × 1011 |
| Example 7 | Lock stitch | Twisted yarn | Crimped yarn | Safety stitch | 3 | 5 | 3 | 5.52 × 106 | 2.85 × 1010 | 3.58 × 1011 |
| Example 8 | Double chain stitch | Twisted yarn | Crimped yarn | Flat felled stitch | 4 | 4 | 3 | 6.68 × 106 | 7.81 × 107 | 3.42 × 108 |
| Example 9 | Lock stitch | Twisted yarn | Crimped yarn | Flat felled stitch | 4 | 4 | 3 | 6.34 × 106 | 5.29 × 107 | 9.89 × 107 |
| Example 10 | Lock stitch | Twisted yarn | Crimped yarn | Safety stitch | 3 | 3 | 3 | 6.85 × 106 | 4.77 × 109 | 3.51 × 1010 |
| Comparative example 1 | Lock stitch | Twisted yarn | | Safety stitch | 3 | 7 | 2 | 6.25 × 106 | >1.00 × 1012 | >1.00 × 1012 |
| Comparative example 2 | Lock stitch | Twisted yarn | | Flat felled stitch | 4 | 7 | 2 | 6.43 × 106 | >1.00 × 1012 | >1.00 × 1012 |
| Comparative example 3 | Double chain stitch | Twisted yarn | Crimped yarn | Flat felled stitch | 4 | 8 | 2 | 6.85 × 106 | 3.61 × 1010 | >1.00 × 1012 |

The sewn product of the present invention described above can be suitably used in clothes such as uniform, cap, dust-proof clothing, and other sewn product required for prevention of static charge.

8. The sewn product of claim 6, further comprising a crimped yarn used as a sewing thread.

9. Clothes comprised of the sewn product of claim 6.

* * * * *